US010299972B2

(12) United States Patent
Kuiken et al.

(10) Patent No.: US 10,299,972 B2
(45) Date of Patent: May 28, 2019

(54) HAND DRIVE MECHANISM FOR MOBILE VEHICLE

(71) Applicant: REHABILITATION INSTITUTE OF CHICAGO, Chicago, IL (US)

(72) Inventors: Todd A. Kuiken, Oak Park, IL (US); James Lipsey, Oak Park, IL (US); Frank J. Ursetta, Chicago, IL (US)

(73) Assignee: Rehabilitation Institute Of Chicago, Chicago, IL (US)

( * ) Notice: Subject to any disclaimer, the term of this patent is extended or adjusted under 35 U.S.C. 154(b) by 0 days.

(21) Appl. No.: 15/451,973

(22) Filed: Mar. 7, 2017

(65) Prior Publication Data

US 2017/0252237 A1 Sep. 7, 2017

Related U.S. Application Data

(60) Provisional application No. 62/304,898, filed on Mar. 7, 2016.

(51) Int. Cl.

| | |
|---|---|
| ***A61G 5/02*** | (2006.01) |
| ***A61G 5/14*** | (2006.01) |
| ***A61G 5/08*** | (2006.01) |

(52) U.S. Cl.

CPC ..... *A61G 5/021* (2013.01); *A61G 5/022* (2013.01); *A61G 5/023* (2013.01); *A61G 5/026* (2013.01); *A61G 5/0825* (2016.11); *A61G 5/14* (2013.01)

(58) Field of Classification Search

CPC ..... A61G 5/022; A61G 5/023; A61G 5/024
See application file for complete search history.

(56) References Cited

U.S. PATENT DOCUMENTS 2,847,058 A * 8/1958 Lee ..... A61G 5/022 188/74
4,108,449 A * 8/1978 Rhodes ..... A61G 5/022 180/8.2

(Continued)

FOREIGN PATENT DOCUMENTS

DE 10 2014 006 600 A1 10/2015
JP 07171181 A * 7/1995
JP 09201384 A * 8/1997

OTHER PUBLICATIONS

Love This Pics, "35 Wildly Wonderful Wheelchair Design Concepts," Sep. 7, 2012, retrieved from intemet website: http://www.lovethesepics.com/2012/09/35-wildly-wonderful-wheelchair-design-concepts/ on Apr. 21, 2017, 42 pages.

(Continued)

*Primary Examiner* — Kevin Hurley
(74) *Attorney, Agent, or Firm* — Drinker Biddle & Reath LLP

(57) ABSTRACT

A drive mechanism for a wheelchair may include a hand grip having a continuous track that moves over a drive rotator. The hand grip may have a flat, top surface that extends ventrally from the wheelchair. The drive mechanism may include a drivetrain connected to the drive rotator, such that movement of the hand grip in a dorsal or a ventral direction causes the drive rotator to rotate, and such rotation actuates the drivetrain. The drive mechanism may further comprise a switch. When the switch is in a first position, actuation of the drivetrain drives the wheels of the wheelchair. When the switch is in a second position, actuation of the drivetrain drives a mechanism that lifts the wheelchair into a standing position.

27 Claims, 20 Drawing Sheets

(56) References Cited

U.S. PATENT DOCUMENTS

| | | | | |
|---|---|---|---|---|
| 4,625,984 | A * | 12/1986 | Kitrell | A61G 5/023 280/250 |
| 5,236,398 | A | 8/1993 | Barnett | |
| 7,077,416 | B2 * | 7/2006 | Duarte | A61G 5/023 280/304.1 |
| 7,900,945 | B1 * | 3/2011 | Rackley | A61G 5/023 280/244 |
| 8,905,421 | B2 * | 12/2014 | Hansen | A61G 5/026 280/250.1 |
| 9,101,520 | B2 * | 8/2015 | Goldish | A61G 5/14 |
| 2015/0084307 | A1 | 3/2015 | Goldish et al. | |

OTHER PUBLICATIONS

PCT Search Report and Written Opinion issued in related application PCT/US2017/021097, dated Jun. 12, 2017, 7 pages.

* cited by examiner

HAND DRIVE MECHANISM FOR MOBILE VEHICLE

CROSS-REFERENCE TO RELATED APPLICATIONS

This application claims benefit to U.S. Provisional Patent Application No. 62/304,898 filed on Mar. 7, 2016, which is herein incorporated by reference in its entirety.

FEDERALLY SPONSORED RESEARCH OR DEVELOPMENT

This invention was made with government support under H133E130020 awarded by the National Institute for Disability and Rehabilitation Research (NIDRR). The government has certain rights in the invention.

FIELD

The embodiments described herein relate to the field of hand drive mechanisms for mobile vehicles.

BACKGROUND

Currently, approximately 1.7 million Americans use wheelchairs or scooters for assisted mobility in their homes and communities (LaPlante 2000). Many of these individuals use manual wheelchairs, which are less expensive than electric wheelchairs and provide mobility in a seated position. However, standing is an important ability that has many physical and psychological benefits, including reduced osteoporosis and muscle spasticity, increased independence in work and social environments, and the ability to look at people at eye level when having a conversation (Pronk et al. 2012). Standing also allows a user to have greater ability while at home or at work. For instance, a wheelchair user who can stand can reach higher kitchen cabinets, change light bulbs, and perform other activities that require a higher reach.

SUMMARY

A drive mechanism for a wheelchair may include a hand grip having a continuous track that moves over a drive rotator. The hand grip may have a flat, top surface that extends ventrally from the wheelchair. The drive mechanism may include a drivetrain connected to the drive rotator, such that movement of the hand grip in a dorsal or a ventral direction causes the drive rotator to rotate, and such rotation actuates the drivetrain. The drive mechanism may further comprise a switch. When the switch is in a first position, actuation of the drivetrain drives the wheels of the wheelchair. When the switch is in a second position, actuation of the drivetrain drives a mechanism that lifts the wheelchair into a standing position.

The foregoing and other aspects of the various embodiments will become more apparent from the following detailed description, when considered in conjunction with the accompanying drawings.

DETAILED DESCRIPTION

In one embodiment, a plurality of hand drive mechanisms are incorporated into a mobile vehicle. The hand drive mechanisms may allow the user of the mobile vehicle to drive the wheels of the mobile vehicle while the user is seated in the mobile vehicle or while the user is standing in the mobile vehicle. Using the hand drive mechanisms, the user may manually drive the mobile vehicle. The mobile vehicle may have a sitting position and a standing position. The mobile vehicle may be positioned in one of a number of intermediate positions between the sitting position and the standing position. The user may manually drive the mobile vehicle in one or more of the sitting position, the standing position, or the intermediate positions. The hand drive mechanism may provide the user longer strokes than the user is able to generate using other mobile vehicles, such as a traditional wheelchair. The hand drive mechanism may also provide a more natural fore and aft motion for propulsion. Additionally, the interface between the user's hand and the hand drive mechanism is customizable to fit the user more comfortably. One suitable mobile vehicle is a wheelchair, for instance the manual standing wheelchair described by U.S. Pat. No. 7,165,778 to Kuiken, incorporated by reference.

In an embodiment, a drive mechanism for a wheelchair comprises a roller chain with hand grips attached using pins extended from the roller chain into the hand grips and held in position by e-clips. The chain may be tensioned by two sprockets held at a fixed distance by a frame. A channel may be mounted to the frame that restricts the movement of the chain to fore and aft directions. One of the sprockets may be an idler sprocket, which is supported by an idler shaft and bearings. During operation, the idler sprocket maintains tension in the roller chain, but does not transmit force. The second sprocket may be a drive sprocket that is supported by a drive shaft and bearings. The drive shaft may be fixed to the drive sprocket in a manner that transfers linear motion input by the wheelchair user on the roller chain through the hand grips to rotational motion in the drive shaft. The rotational motion of the drive shaft is then used for driving the wheels of a wheelchair. In another embodiment, a timing belt or other belt tensioned between two pulleys can replace the roller chain and sprockets. In another embodiment, the drive mechanism may further comprise a hand grip that is merged with the roller chain or belt as one component. In another embodiment, a substantial amount of tension may be applied to the chain such that a supporting channel is unnecessary, and the chain is stiff when the user applies force to the hand grips.

Figure 1:
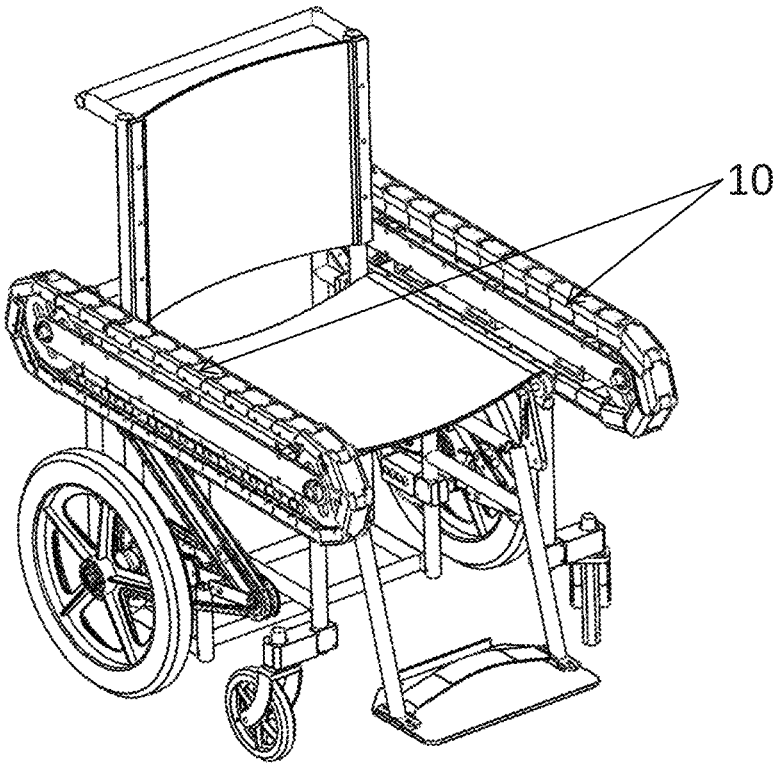
FIG. 1 is a perspective view of an embodiment of hand drive mechanisms attached to a wheelchair.

Corresponding reference characters indicate corresponding elements among the view of the drawings. FIG. 1 displays a perspective view of two hand drives 10 attached to a wheelchair 100. The hand drives 10 may be positioned such that the user may apply force in the fore or aft direction. Wheels 40 may be positioned at the rear of the wheelchair. In one embodiment, shown in FIG. 1, two wheels 40 are positioned on each side of the wheelchair 100.

Figure 2:
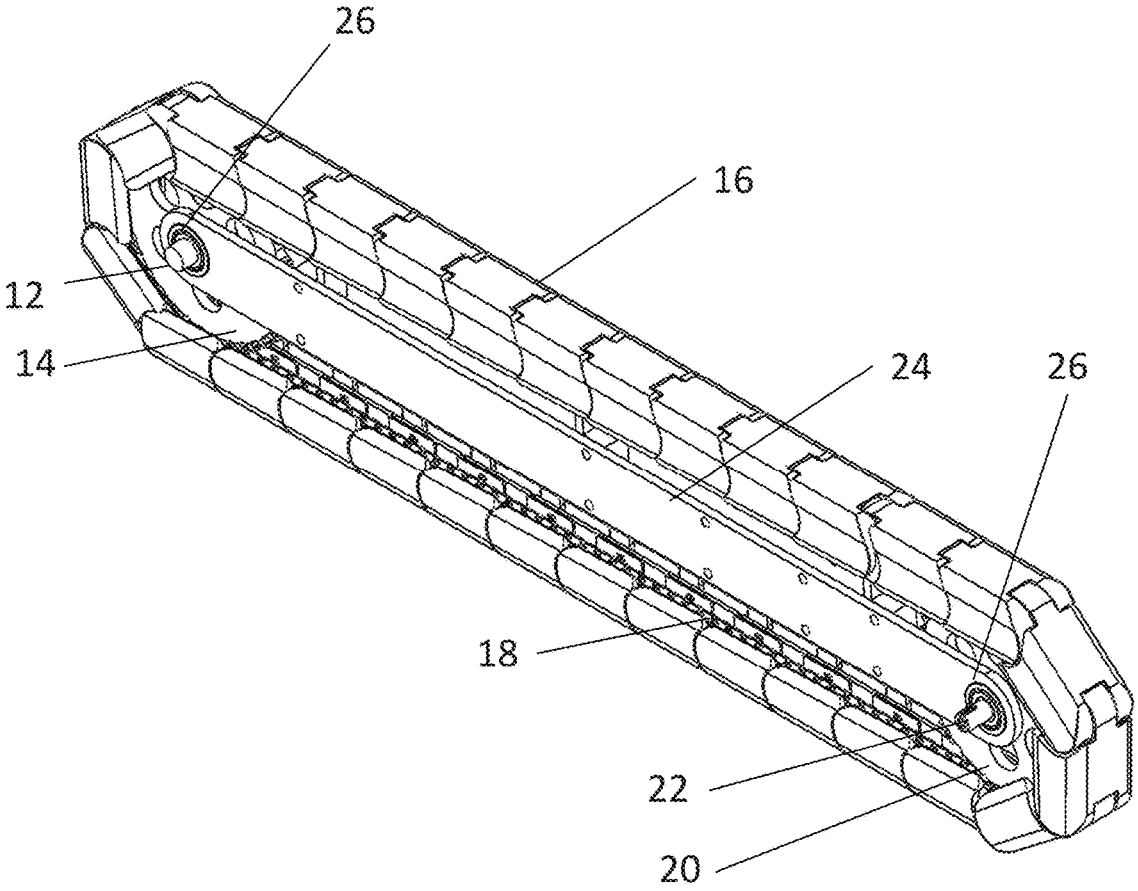
FIG. 2 is a perspective view of an embodiment of a hand drive mechanism.
Figure 3:
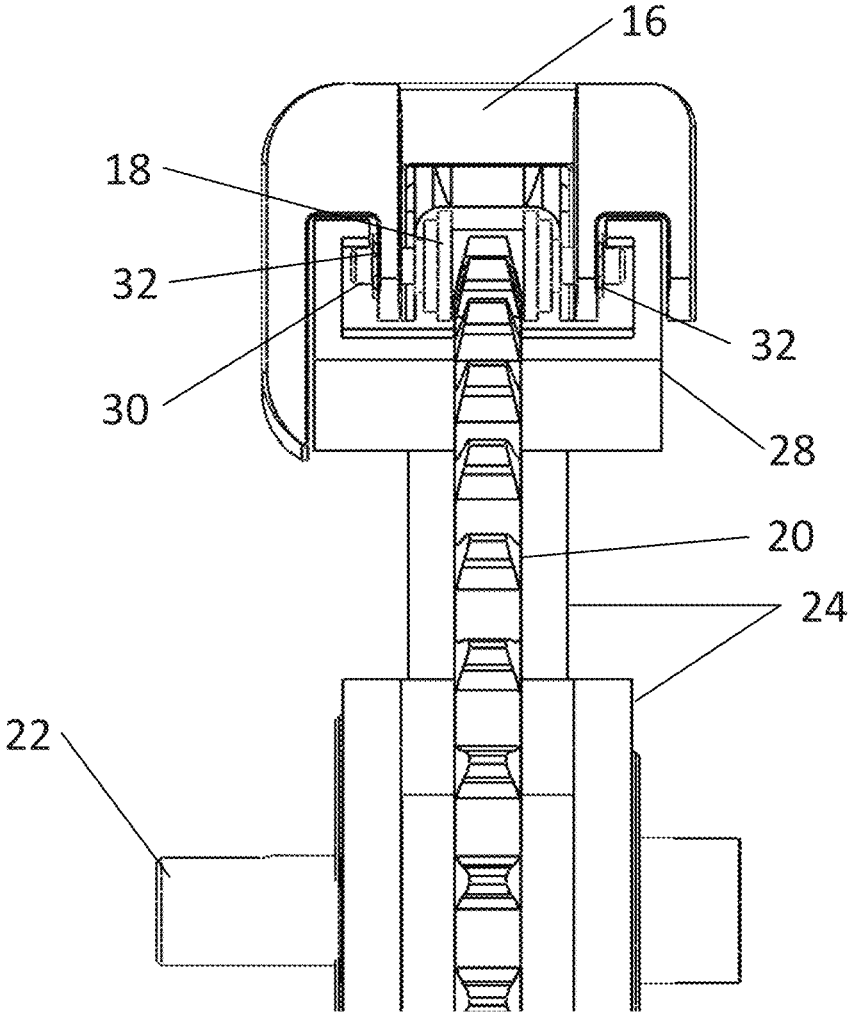
FIG. 3 is a rear view of a portion of an embodiment of a hand drive mechanism.

FIG. 2 displays a perspective view of an embodiment of a hand drive 10. In one embodiment, the hand drive 10 comprises a hand grip 16, which provides a surface on which the user can push. The hand grip 16 can take on a variety of sizes and shapes to fit the comfort of the user. The hand grip 16 transfers the pushing force of a user to a roller chain 18. Roller chain 18 is an example of a continuous track. The hand grip 16 may be made up of separate hand grip segments 16*s*, as shown in FIG. 2 and FIG. 3. The roller chain 18 may assist in converting the force provided by the user on the hand grip 16 to rotational motion. In the embodiment shown in FIG. 2, the roller chain 18 interlocks with the teeth of a drive rotator 20, which converts the force provided by the user to rotational motion. In other embodiments, another continuous track, such as a timing belt or a mechanical drive belt that transmits linear motion into rotational movement, may be used in place of the roller chain 18. The hand grip 16 is in a "tread arrangement," which means that when the user pushes the hand grip 16 in a fore direction, a portion of the hand grip 16 that is on the top surface of the hand drive 10, moves along the top surface of the hand drive 10 in a fore direction, then over the front face of the hand drive 10, then along the bottom surface of the hand drive 10 in an aft direction, then over the back face of the hand drive 10, and finally back to its starting position. In this way, the hand grip 16 is positioned similarly to the tread of a tank.

The hand drive mechanism 10 may further comprise an idler shaft 12 on which the idler sprocket 14 rotates. The idler sprocket 14 maintains tension on the roller chain 18 and assists in providing a smooth movement of the roller chain 18. In other embodiments, a smooth surface that maintains tension on the roller chain 18 may be used instead of an idler sprocket 14.

As mentioned above, the roller chain 18 may be connected to the drive rotator 20. The drive rotator 20 transfers linear motion from the roller chain 18 into rotational motion that can be used to drive a wheel of a mobile vehicle. In the embodiment shown in FIG. 2, the drive rotator 20 may comprise a sprocket. In another embodiment, the drive rotator 20 may comprise a round bearing surface that rotates as the roller chain 18 moves over it. The drive rotator 20 is connected to the drive shaft 22, which provides the rotational output force that can drive a wheel of the mobile vehicle. Bearings 26 may be used to reduce friction between the rolling surface of the drive rotator 20 and the drive shaft 22 and also may be used elsewhere throughout the hand drive mechanism 10 in order to reduce friction between other various rolling surfaces. Alternately, bushings may be used in place of bearings 26. Various components of the hand grip mechanism 10 may be connected to the frame 24, and the bearings 26 may be held at a fixed distance by frame 24, which may be rigid. In one embodiment, the fixed distance between the teeth of the sprockets 20 maintains the tension on the roller chain 18.

FIG. 3 displays a rear view of a portion of an embodiment of the hand drive mechanism 10. As shown in FIG. 3, the hand grip 16 may be connected to the roller chain 18 by a pin 30, which, in one embodiment, extends from the roller chain 18 and into the hand grip 16. Each pin 30 may transfer the pushing force on the hand grip 16 to the roller chain 18. In another embodiment, the hand grip 16 and roller chain 18 may be integrated into a single component. Clips 32 may be used to keep the pin 30 in position. Each segment of the hand grip 16*s* may be connected to the roller chain 18 using a pin 30 and clips 32. As shown in FIG. 3, the roller chain 18 and hand grip 16 may be at least partially positioned inside of a channel 28. The channel 28 may be a rigid structure that restricts the roller chain 18 and hand grips 16 to only fore and aft movements. The channel 28 also supports the downward forces put on the hand grip 16 when the user pushes on it. This feature can make the hand drive 10 feel more stable to the user during operation. In another embodiment, the channel 28 could be removed and the tension in the roller chain 18 increased. The roller chain 18, given sufficient tension, restricts the movement outside of the fore and aft movement of the hand grips 16 and provides enough stability to the user when applying force to the hand grips 16.

Figure 4:
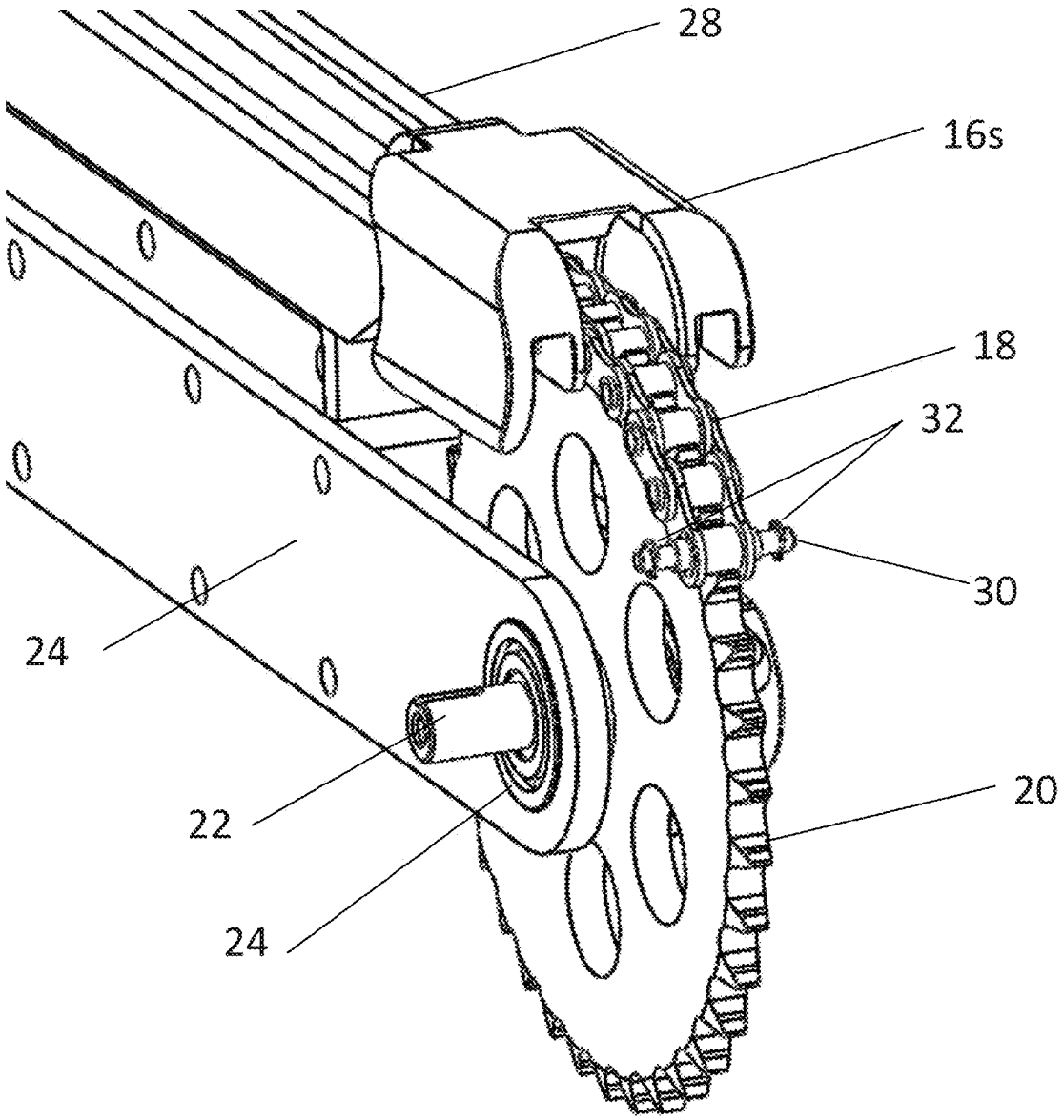
FIG. 4 is a perspective view of a portion of an embodiment of a hand drive mechanism.

FIG. 4 displays a perspective view of a portion of the hand drive 10. Only one segment of the hand grip 16*s* is shown, to better display the inner mechanisms and operation of the hand drive 10. FIG. 4 displays the roller chain 18 in the channel 28. The channel 28 restricts the movement of the roller chain 18, hand grip 16*s* and pin 30 to only the fore and aft directions. This allows the hand grip 16*s* to be both mobile and supportive under the forces applied by the wheelchair user, which provides the user with a feeling of additional stability. In the embodiment shown in FIGS. 3 and 4 the channel 28 is flat. In other embodiments, the channel 28 could be shaped in other ways in order to support the roller chain 18. In other embodiments, the channel 28 could have a rounded shape, so as to gently arc from the fore position of the hand drive 10 to the aft position of the hand drive 10.

Figure 5:
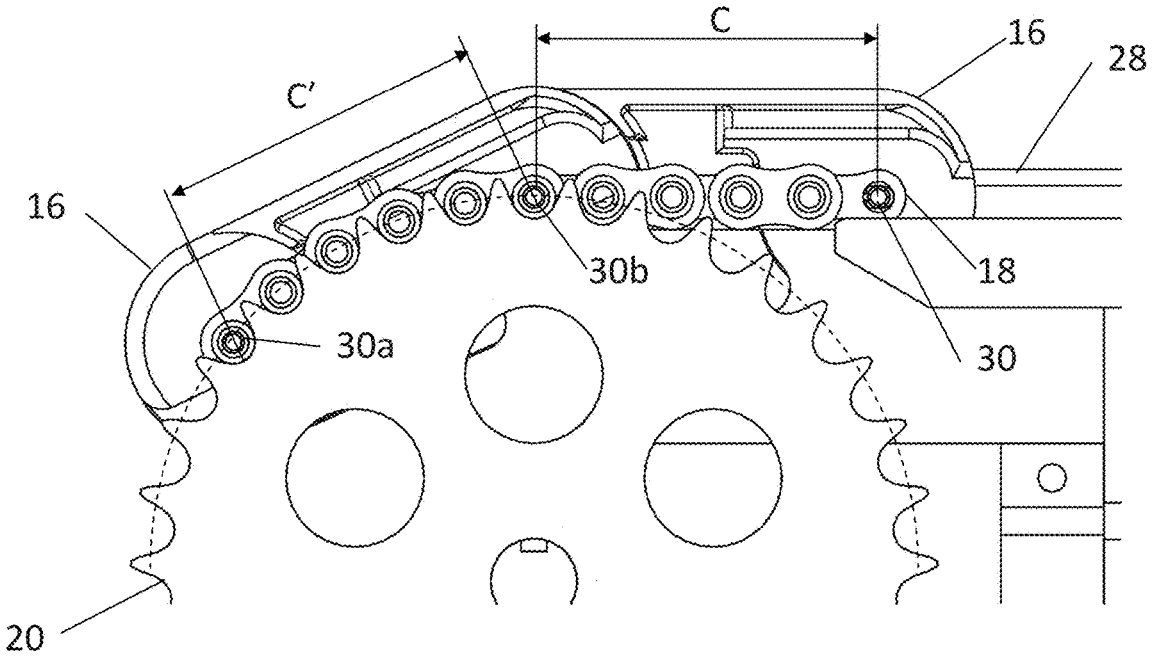
FIG. 5 is a cross-sectioned side view of a portion of an embodiment of a hand drive mechanism.
Figure 5B:
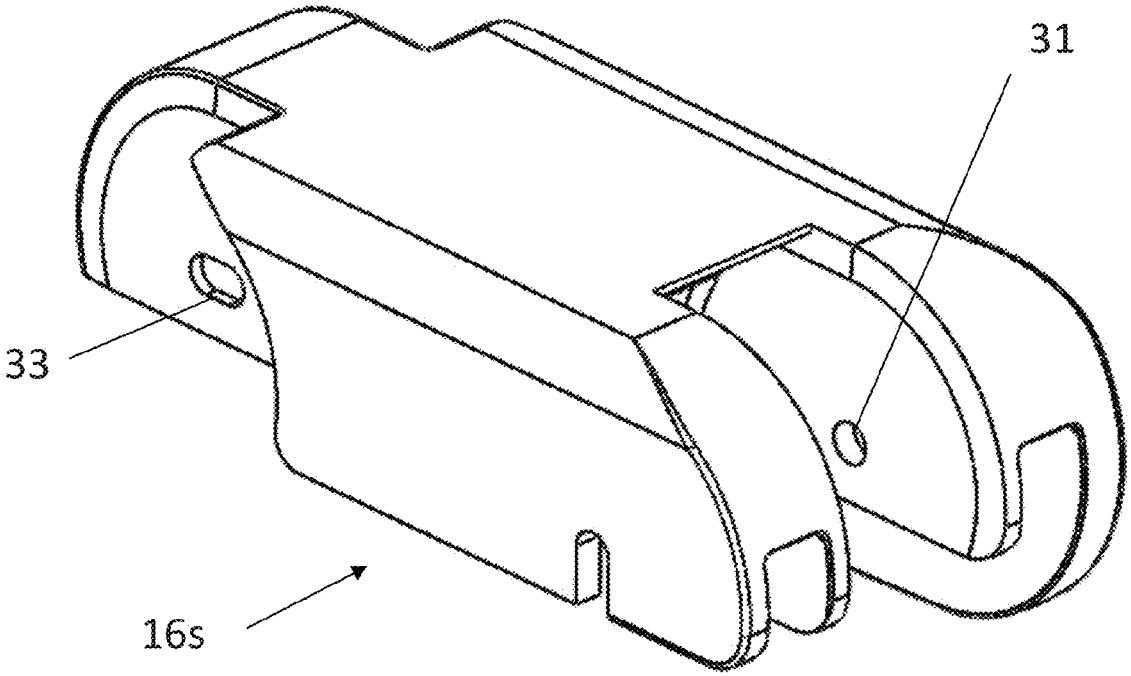
FIG. 5B is a perspective view of an embodiment of a hand grip segment.
Figure 6:
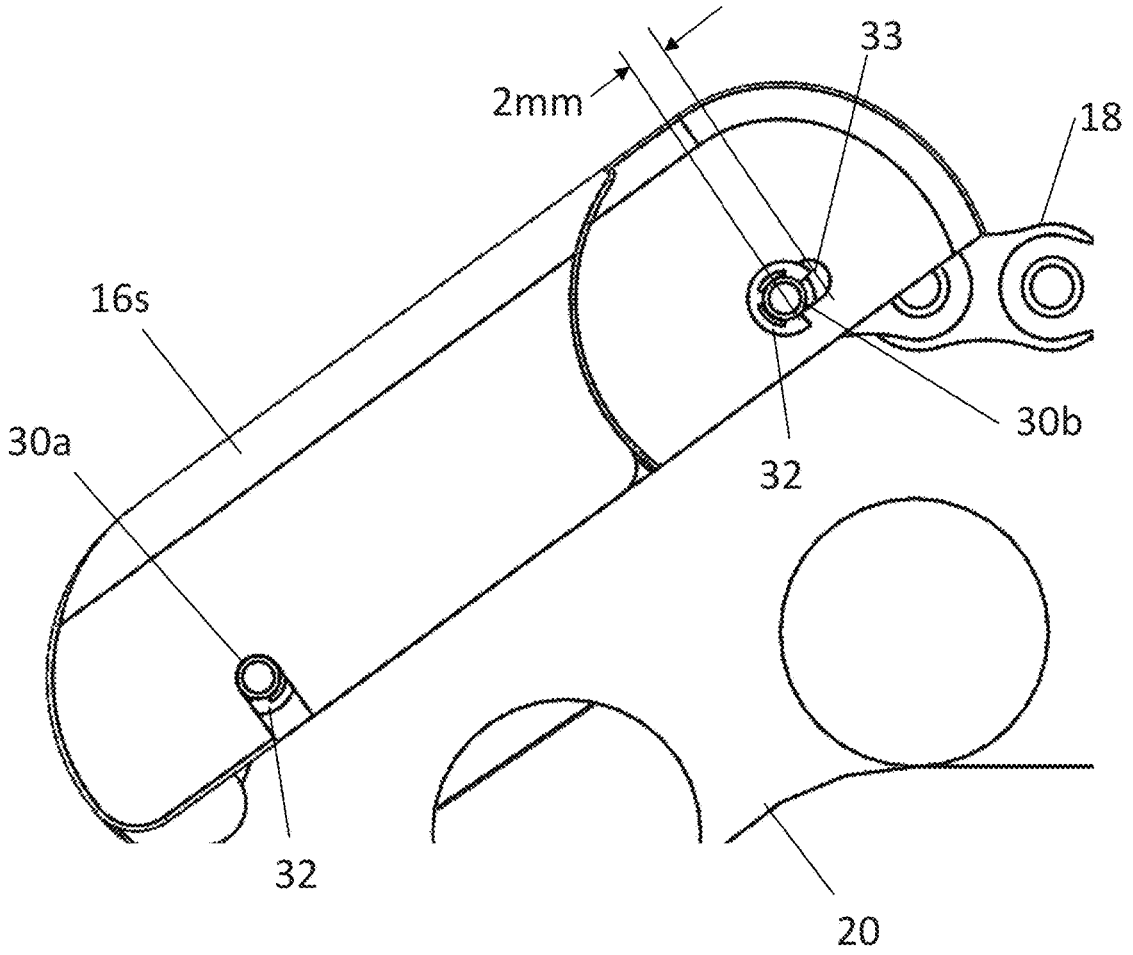
FIG. 6 is a side view of an embodiment of a hand grip segment.

FIG. 5 displays a cross-sectioned side view of a portion of the hand drive 10. Only two hand grip segments 16*s* and certain links of the roller chain 18 are shown, to better display the inner mechanisms and describe the operation of the hand drives 10. Each segment of the hand grip 16*s* may be attached to the roller chain 18 by an extended pin 30. In the embodiment shown in FIG. 5, the extended pin 30 extends from the roller chain 18 every fifth chain link. It should be understood that pins could be placed in alternate positions. In one embodiment, the hand grip segment 16*s* has a hole 31 and a slot 33, as shown in FIG. 5B. FIG. 6 shows a first pin 30*a* inserted into hole 31 and a second pin 30*b* inserted into slot 33. Pins 30*a* and 30*b* connect to roller chain 18.

In one embodiment, the hand grip segment 16*s* may be configured to smoothly rotate around the drive rotator 20. As the hand grip segment 16*s* begins to rotate around the drive sprocket 20, the distance between the first pin 30*a* and the second pin 30*b* changes. The distance between two adjacent extended pins 30 is marked as C in FIG. 5. As the roller chain 18 wraps around the drive rotator 20, the distance C between the extended pins 30 decreases, due to the curvature of the drive rotator 20. As the hand grip segment 16*s* transitions from traveling towards the drive rotator 20 to traveling around the circumference of the drive rotator 20, second pin 30*b* shifts laterally within the slot 33, towards first pin 30*a*. As the hand grip segment 16*s* transitions from traveling around the circumference of the drive rotator 20 to traveling away from the drive rotator 20, the second pin 30*b* shifts laterally within the slot 33, away from first pin 30*a*. In this way, hole 31 acts as a pivot constrained to the roller chain 18 and the slot 33.

The roller chain 18 may move in a fore or aft direction. The fore or aft movement of the roller chain 18 can be caused by force applied to the hand grip 16*s* by the user. The movement of the roller chain 18 rotates the idler sprocket 14 and the drive rotator 20 on which it is wrapped. In one embodiment, the idler sprocket 14 and the idler shaft 12 do not transmit force but are used to maintain tension in the roller chain 18. The drive rotator 20 may be rigidly fixed to the drive shaft 22 so that rotational motion of the drive rotator 20 is transferred to the drive shaft 22. The rotational motion of the drive shaft 22 may be transferred to the large rear wheel 40 of the wheelchair 100. Many methods for transferring rotational motion from one shaft to another are well known.

Figure 7:
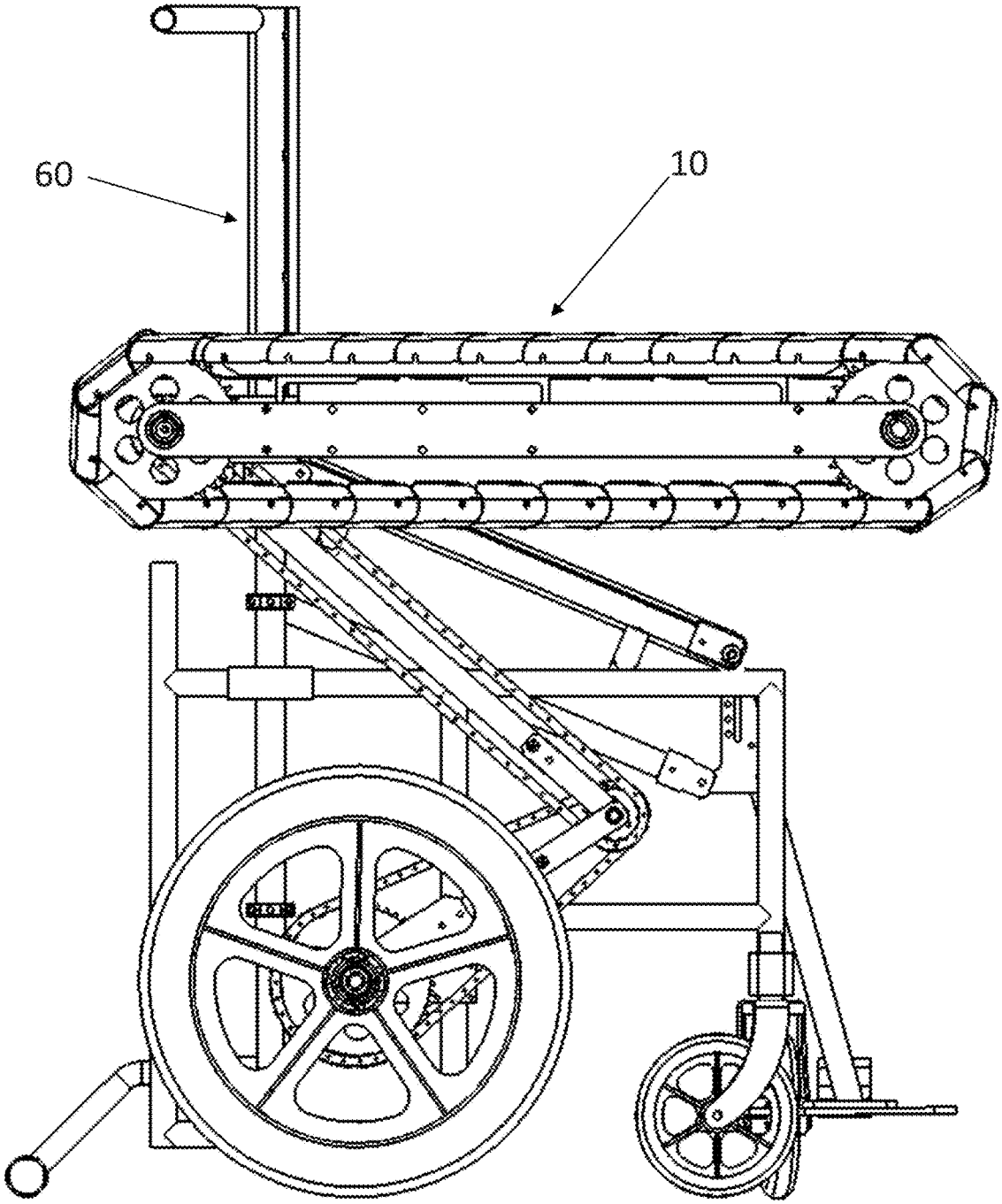
FIG. 7 is a side view of an embodiment of a hand drive mechanism attached to a wheelchair that is in a partial standing position.
Figure 8:
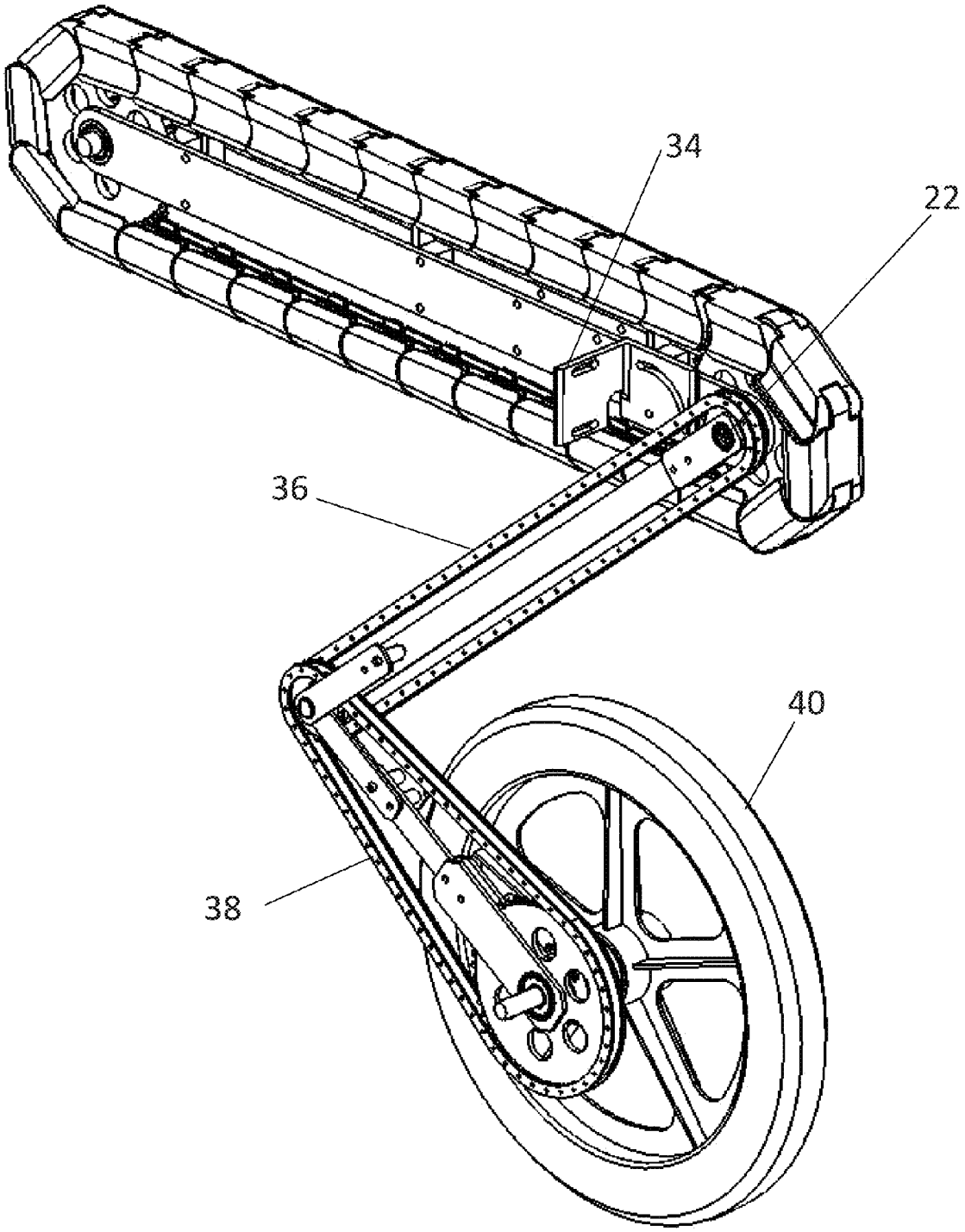
FIG. 8 is a perspective view of an embodiment of a hand drive mechanism and a portion of an embodiment of an articulating linkage mechanism coupled to a wheelchair wheel.

In one embodiment, the transition from a sitting wheelchair to a standing wheelchair may employ an articulating linkage mechanism to transfer the rotational motion from the drive shaft 22 to wheel 40. FIG. 8 displays a portion of one embodiment of an articulating linkage mechanism 80. A hand drive connection bracket 34 may be used to mount the hand drive 10 to the wheelchair backrest 60 (as shown in FIG. 7). The articulating linkage mechanism 80 may further comprise an upper link roller chain 36 that transfers the rotational motion from the small drive sprocket 42 to the outer intermediate sprocket 46. The articulating linkage mechanism 80 also may further comprise a lower link roller chain 38, which may transfer the rotational motion from the inner intermediate sprocket 48 to the wheel drive sprocket 54.

Figure 9:
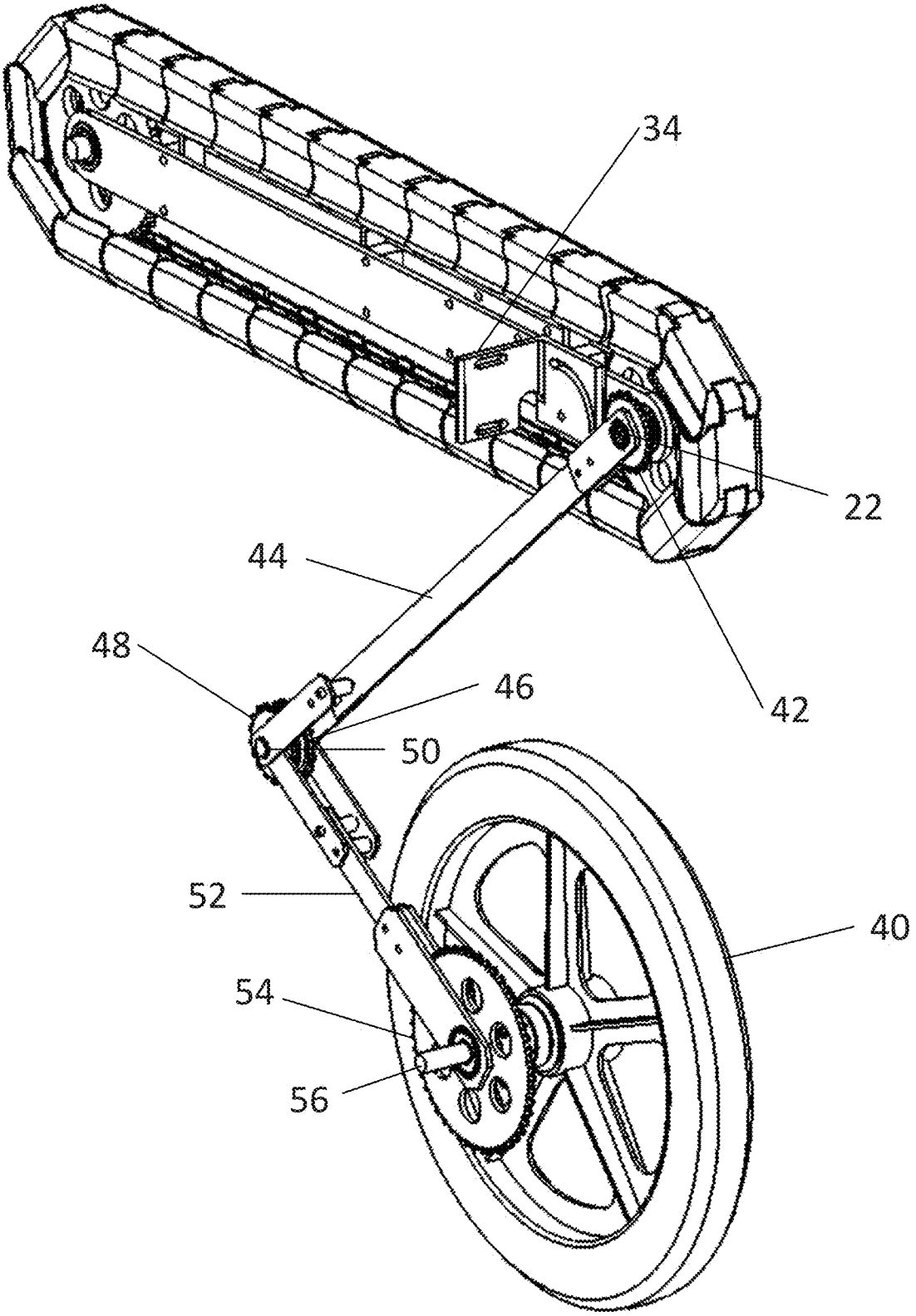
FIG. 9 is a perspective view of an embodiment of a hand drive mechanism and a portion of an embodiment of an articulating linkage mechanism coupled to a wheelchair wheel.

In FIG. 9, the upper link roller chain 36 and lower link roller chain 38 are not shown, therefore allowing the reader to more easily view other portions of the articulating linkage mechanism 80 used to transfer rotational motion from the drive shaft 22. The uppermost small drive sprocket 42 may be rigidly attached to the drive shaft 22. An upper link 44 may also be connected at its top portion to the drive shaft 22. The upper link 44 may be attached with a bearing 26 (not shown) so that it does not hinder the rotation of the drive shaft 22. The bottom portion of the upper link 44 may be mounted on a bearing and may be connected to top portion of an intermediate shaft 50, allowing it to rotate. An outer intermediate sprocket 46 and an inner intermediate sprocket 48 may be mounted to the intermediate shaft 50. Sprockets 46 and 48 are rigidly fixed to each other such that they rotate together about the intermediate shaft 50. The outer intermediate sprocket 46 transfers the rotational motion of the drive shaft 22 though the upper link roller chain 36 (shown in FIG. 8) to the inner intermediate sprocket 48. The inner intermediate sprocket 48 transfers the rotational motion from the outer intermediate sprocket 46 to the lower link roller chain 38 (shown in FIG. 8). The upper link 44, lower link 52, and both intermediate sprockets 46 and 48 may be constrained to the intermediate shaft 50 through bearings 26 (not shown), but are also free to rotate about the shaft 50. In another embodiment, sprockets 46 and 48 could swap positions within the articulating linkage mechanism 80.

The upper link roller chain 36 connects the small drive sprocket 42 to the outer intermediate sprocket 46. The distance between the small drive sprocket 42 and the outer intermediate sprocket 46 may be held fixed by an upper link 44. The upper link 44 may keep the upper link roller chain 36 in tension and therefore allows for an effective transfer of the rotational motion from the drive shaft 22. The upper link 44 may be a rigid structural member that maintains the tension in the upper link roller chain 36 by keeping constant the distance between the drive shaft 22 and the intermediate shaft 50. The lower link 52 may be a rigid structural member that maintains the tension in the lower link roller chain 38 by keeping constant the distance between the intermediate shaft 50 and wheel axle 56.

The upper end of the lower link 52 is attached with a bearing 26 to the intermediate shaft 50 so that it does not hinder the rotation of the intermediate shaft 50. The bottom end of the lower link 52 is also mounted on a bearing 26 and connected to the wheel axle 56, allowing the wheel axle 56 to rotate. The lower link roller chain 38 connects the inner intermediate sprocket 48 to the wheel drive sprocket 54. The wheel drive sprocket 54 transfers the rotational motion from the inner intermediate sprocket 48 through the lower link roller chain 38 to the wheel 40 through a hub 74. The wheel hub 74 rotates around the wheel axle 56 and rigidly connects the wheel drive sprocket 54 to the wheel 40. The wheel drive sprocket 54 may rotate on a bearing 26 about the wheel axle 56. The wheel axle 56 may be a stationary axle on which the wheel drive sprocket 54 and wheel 40 rotate. It may be rigidly connected to the base of the frame of the wheelchair 100.

The distance between the inner intermediate sprocket 48 and the wheel drive sprocket 54 is held fixed by the rigid lower link 52, which keeps the lower link roller chain 38 (FIG. 8) in tension and therefore allows for an effective transfer of rotational motion from the intermediate shaft 50. The wheel drive sprocket 54 is attached to the wheel 40 through the wheel hub 74 which transfers the rotational motion. The articulating linkage mechanism shown in FIG.

8 and FIG. 9 may be mirrored on the opposite side of the wheelchair 100 to allow the user to drive each wheel 40 individually.

Figure 10:
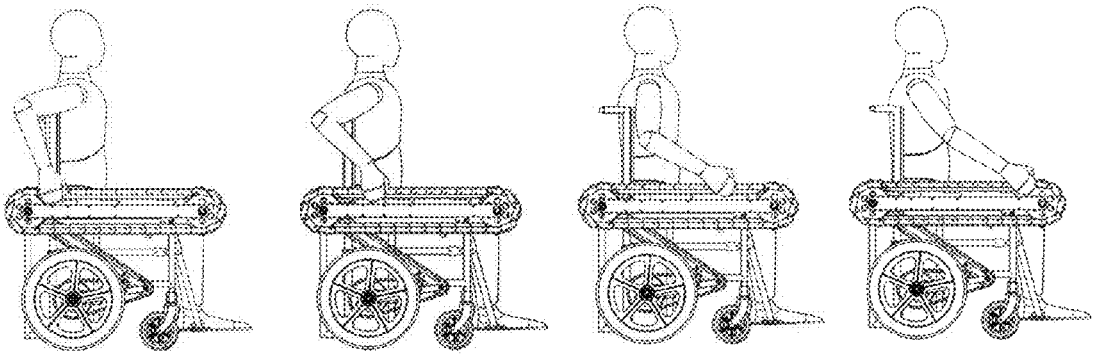
FIG. 10 is a side view of a series of figures showing a user operating an embodiment of a hand drive powered wheelchair to drive the wheelchair.
Figure 11:
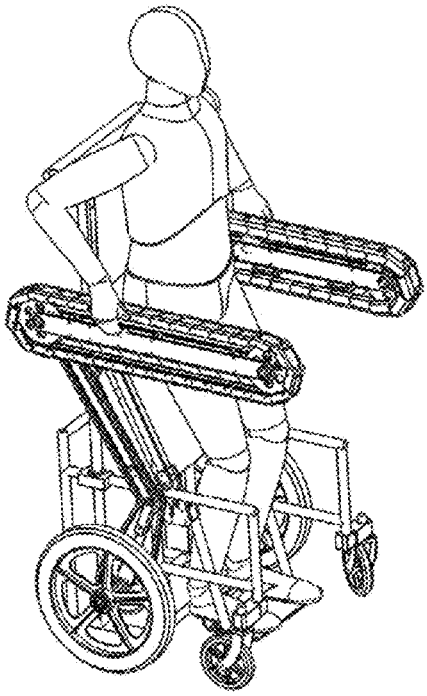
FIG. 11 is a perspective view of a user operating an embodiment of a hand drive powered wheelchair in a standing position.
Figure 12:
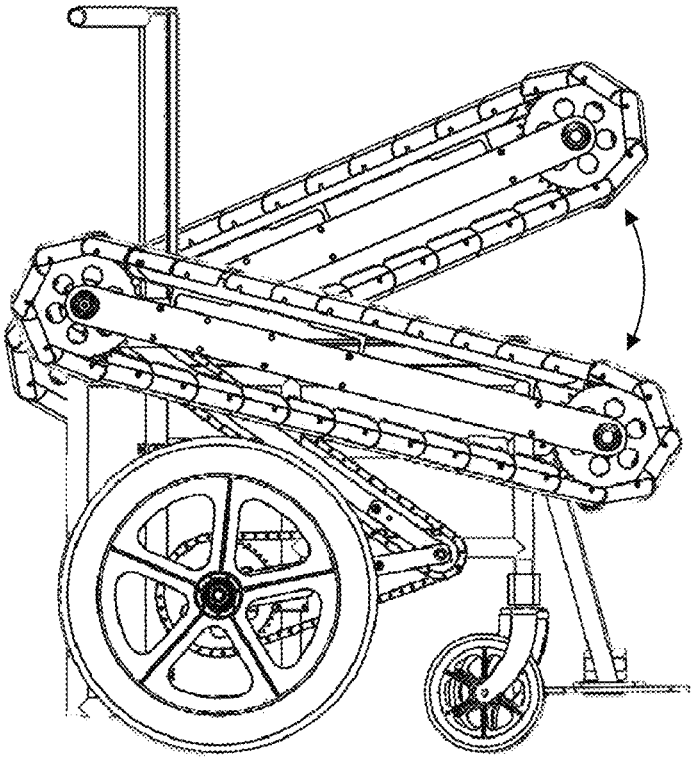
FIG. 12 is a side view of an embodiment of two hand drive mechanisms.

FIG. 10 shows how a user of the wheelchair 100 may use hand grips 16 to move the wheelchair 100 forward. The series of images shows the user pushing the hand grips 16 in the fore direction in order to propel the wheelchair 100 forward. FIG. 11 shows the hand drives 10 on a wheelchair 100 in the standing position. The hand drives 10 allow the user to maintain control of the wheelchair wheels 40 while in a standing position. The hand drives 10 may be rotatably adjusted to other non-horizontal positions. For instance, FIG. 12 shows a hand drive 10 at a modified angle of action for hand movement. Hand drive 10 is rotated from a first non-horizontal position to a second non-horizontal position. Flexibility in the angle of action for hand movement can allow the user to have more comfort in driving the wheelchair 100.

In another embodiment (not shown) the hand drive 10 need not be attached to a standing wheelchair 100, but could be used on ordinary wheelchairs or other mobile vehicles. Certain benefits of some of the embodiments described here include a larger grip surface, better action angle for hand movement, and a longer and more comfortable stroke for driving the wheels 40. The hand grips 16 may be customized and made to fit the user's preferences further improving the level of comfort.

In an embodiment in which the wheelchair 100 does not transition from sit to stand, a simpler mechanism for transferring the rotational movement of the drive shaft 22 to the wheel axle 56 could be used.

In yet another embodiment (not shown), roller chain 18 and sprocket mechanism 20 could be replaced with a timing belt or other belt tensioned between two pulleys. The hand grips 16 could be attached to this belt. The rotation of the pulleys can then be used to rotate the drive shaft 22 and ultimately drive the wheelchair 100.

Figure 13:
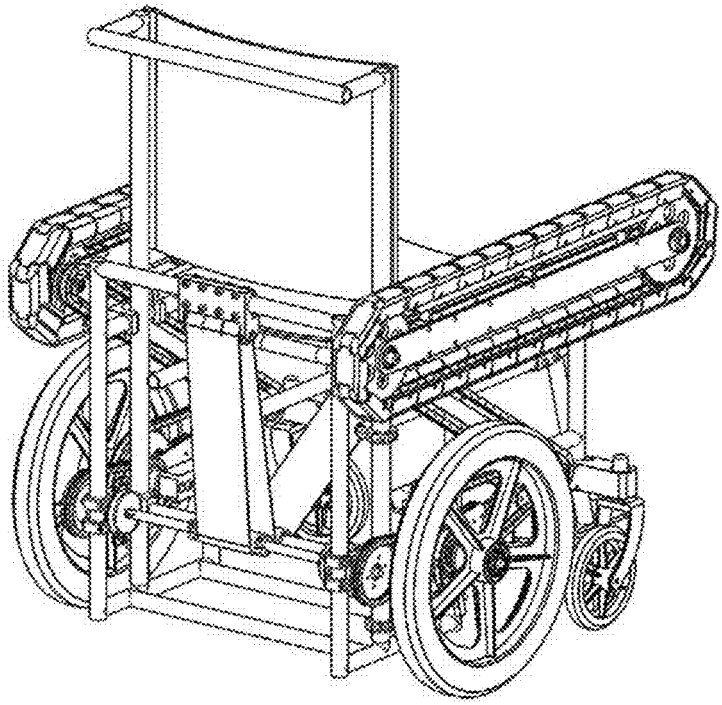
FIG. 13 is a rear perspective view of an embodiment of a hand drive powered wheelchair that includes both the hand drive mechanisms and a lifting system.
Figure 14:
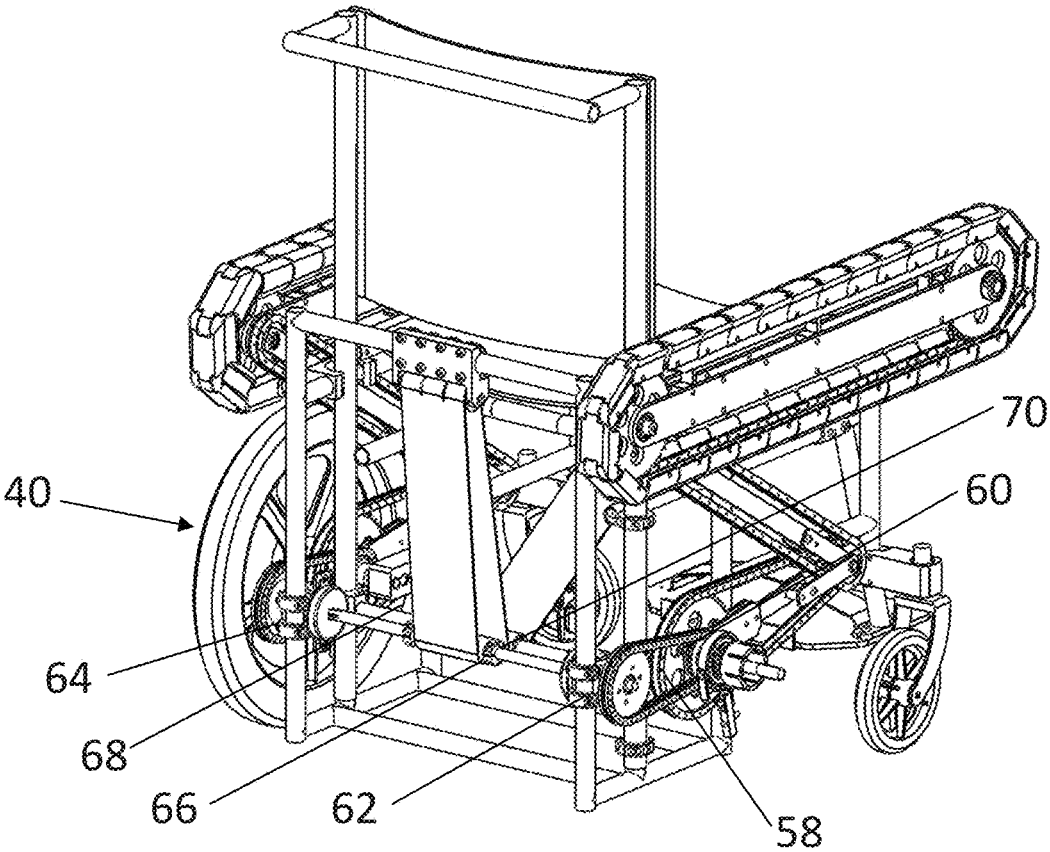
FIG. 14 is a rear perspective view of an embodiment of a hand drive powered wheelchair, with one rear wheel not shown.

In another embodiment a shifting mechanism may be be integrated that allows the hand drive 10 to switch between driving the wheels 40 of the wheelchair 100 to driving a mechanism that lifts up the user into a standing position. This would allow the hand drive system 10 to have dual functionality. One such mechanism is described further in U.S. Pat. No. 7,165,778 to Kuiken, incorporated herein by reference. A more complete version of the wheelchair 100 is shown in FIG. 13. The shifter 58 can be seen more clearly in FIG. 14 in which one of the large rear wheels 40 of the wheelchair 100 is removed. The shifter 58 is a mechanism used to switch between using the hand drive 10 to rotate the wheel hub 74 and rotate a mechanism that lifts the wheelchair 100 into standing position. The shifter 58 allows the wheel drive sprocket 54 to detach from the wheel hub 74 and instead drive the pulley sprocket 62. The pulley sprocket 62 transfers the rotational motion from the shifter 58 to the pulley rod 66. This pulley sprocket 62 is connected to an anti-back-drivable mechanism that prevents the pulley rod 66 from rotating without input from the user. This would prevent the wheelchair 100 while in the standing position from self-lowering the seat 72 under the weight of the user. The input from the user to control the anti-back-drivable mechanism and the shifter 58 can take on many forms. In its present embodiment, several Bowden cables are implemented to allow the user to control these items from an easily accessible location. Knobs are connected to these Bowden cables and are mounted on the outer side of the hand drives 10 giving the user easy access. The rotational damper 64 is attached to the pulley rod 66 and the frame of the wheelchair 100. The purpose of the rotational damper 64 is to make the act of raising and lowering the backrest 60 more smooth and controlled. The damper need not be present in all embodiments. The pulley rod 66 is free to rotate by being mounted in bearings 26 (not shown) that are fixed to the frame. Rotating the pulley rod 66 winds the lift belt which in turn lifts the backrest 60.

The pulley mechanism allows the user to move the wheelchair 100 from a sitting position to a standing position. The path of the lift belt 68 can be seen in FIG. 15 in which the arrows show the direction the belt 68 travels during the lifting process. The lift belt 68 is a flexible belt that is rigidly connected to the pulley rod 66 and the front of the wheelchair seat 72. It travels over two pulleys that are rigidly attached to the frame. As it is wound around the pulley rod 66, the backrest 60 is lifted and the front of the seat 72 is pulled backwards. The backrest pulley 70 is mounted in a bearing 26 (not shown) which is rigidly attached to the backrest 60 of the wheelchair 100. The lift belt 68 is wrapped partially around the backrest pulley 70 and as the pulley is tensioned, lifts the backrest pulley 70 upward. This backrest 60 is free to move up and down as described in Manual Standing Wheelchair (MSW) system (U.S. Pat. No. 7,165,778). The lift belt 68 then travels to the front of the seat 72 where it is rigidly attached.

Figure 15:
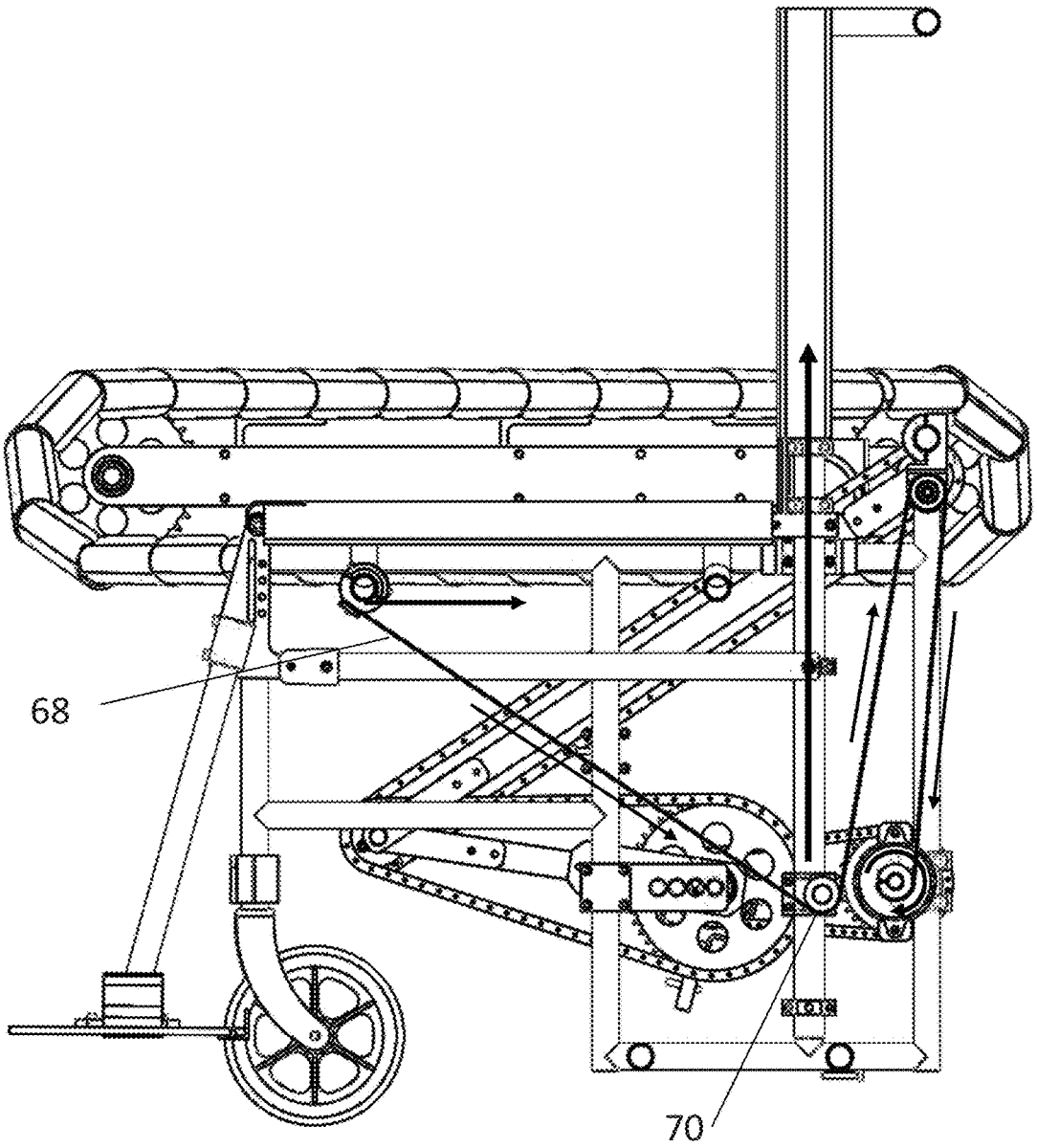
FIG. 15 is a cross-sectioned side view of certain portions of an embodiment of a hand drive powered wheelchair in a sitting position.
Figure 16:
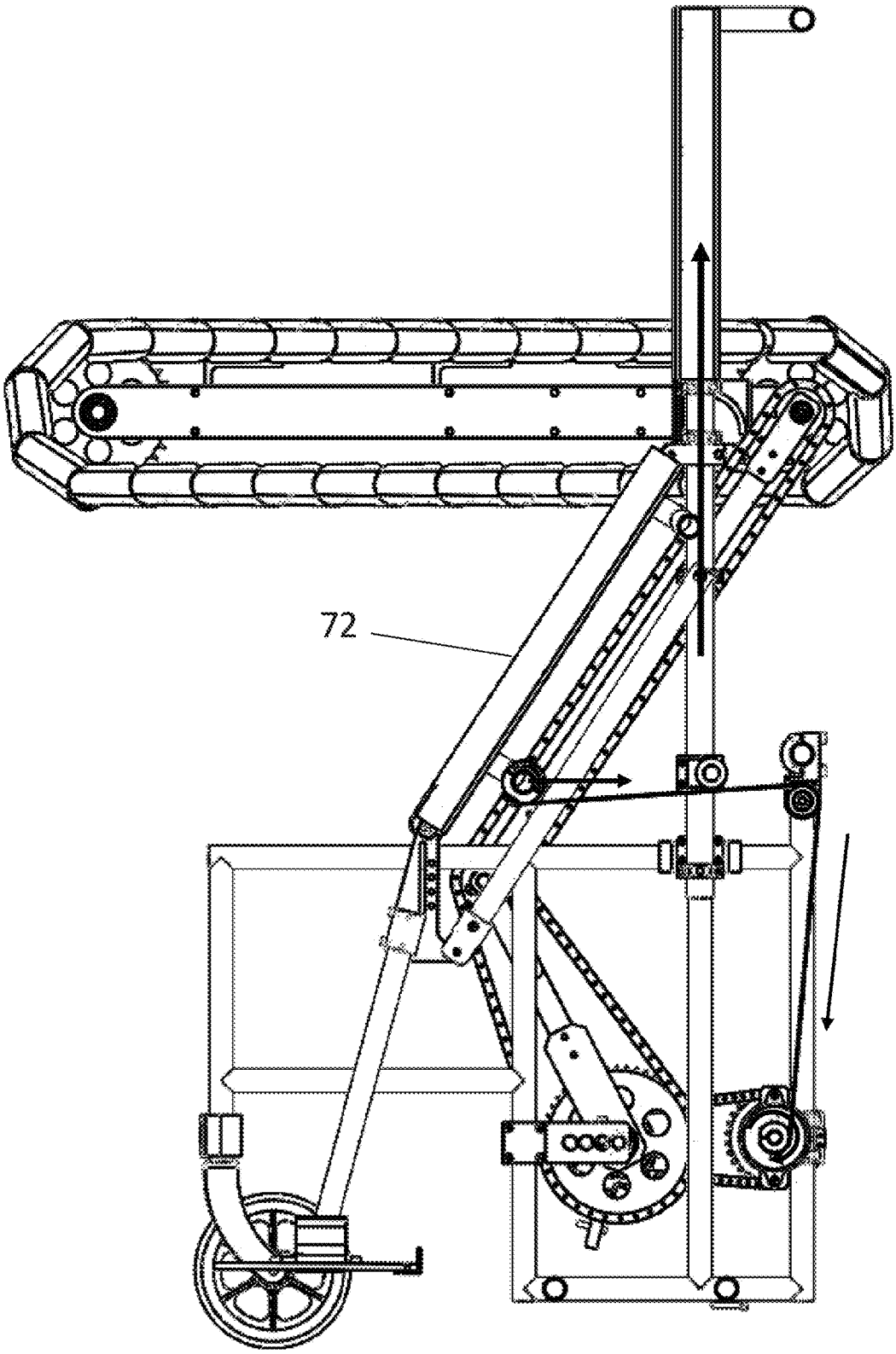
FIG. 16 is a cross-sectioned side view of a portion of an embodiment of a hand drive powered wheelchair in an intermediate position between a sitting position and a standing position.
Figure 17:
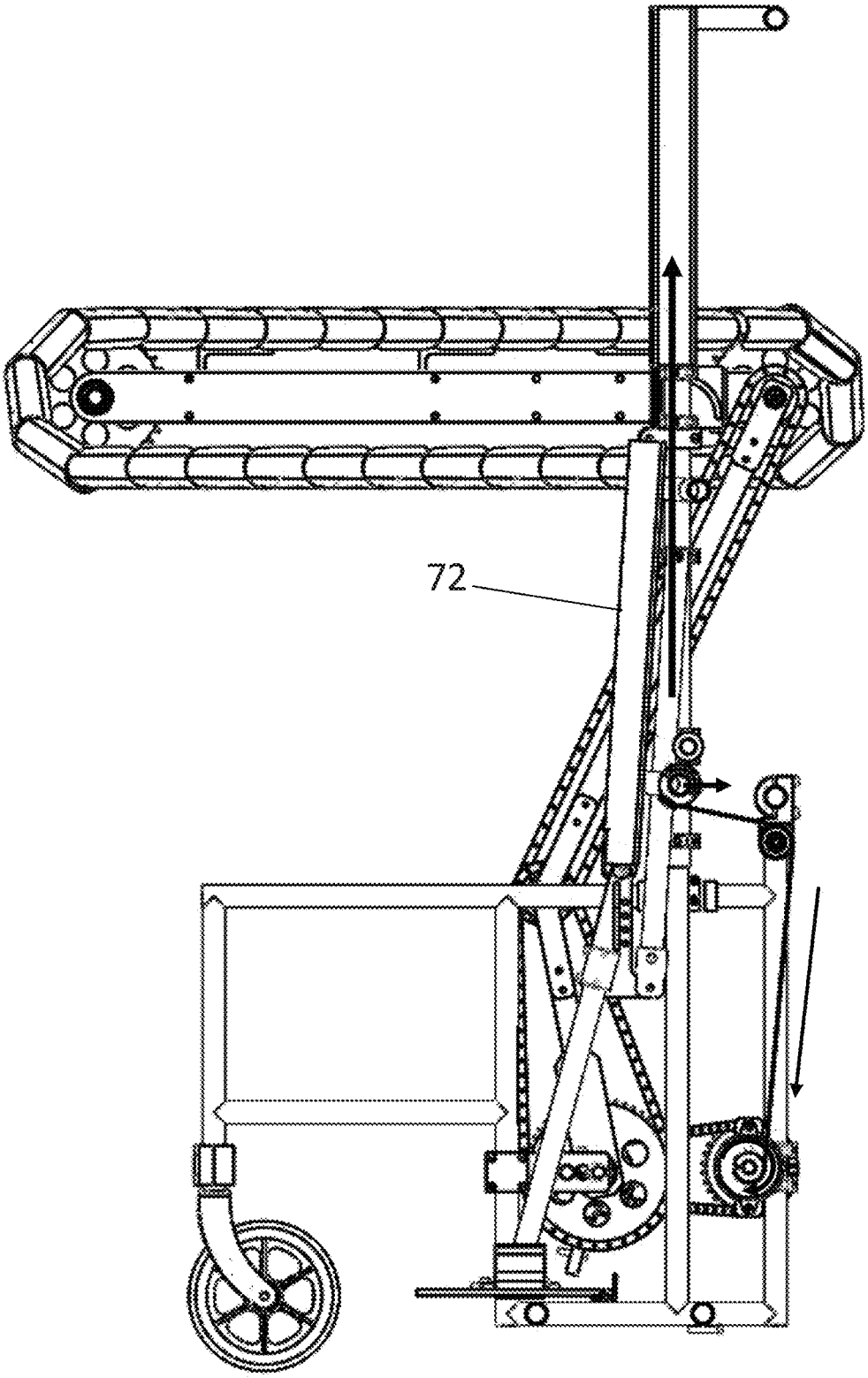
FIG. 17 is a cross-sectioned side view of a portion of an embodiment of a hand drive powered wheelchair in standing position.

Initially, as the pulley rod 66 rotates the backrest 60 moves upward as the lift belt 68 tensions as shown in FIG. 15. During this initial stage the front of the seat 72 moves backward only slightly. Most of the force input by the user goes into lifting the backrest 60. As the backrest 60 goes higher the lift belt 68 engages the backrest pulley less 70 and mostly pulls the front of the seat 72 backwards as shown in FIG. 16. At this point the majority of the force input by the user pulls the front of the seat 72 rearward. This is necessary to ensure that the user reaches a fully upright position. The final position in which the seat 72 is almost completely vertical can be seen in FIG. 17. The pulley need not use a belt specifically, and in other embodiments may use a cable or chain to lift the backrest 60.

Figure 18:
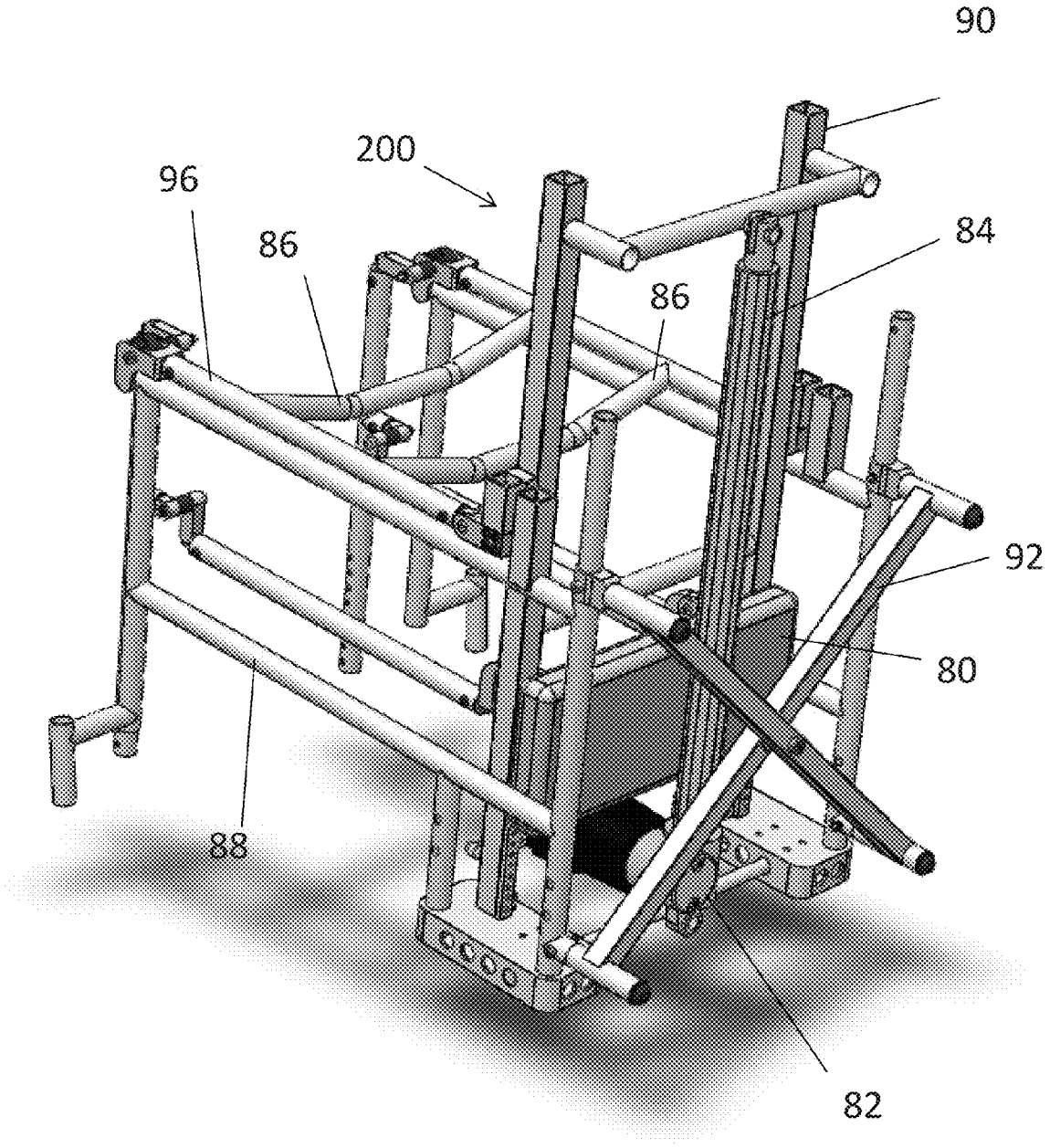
FIG. 18 is an isometric view of an embodiment of a frame of a hand drive powered wheelchair that is foldable and actuated.
Figure 20:
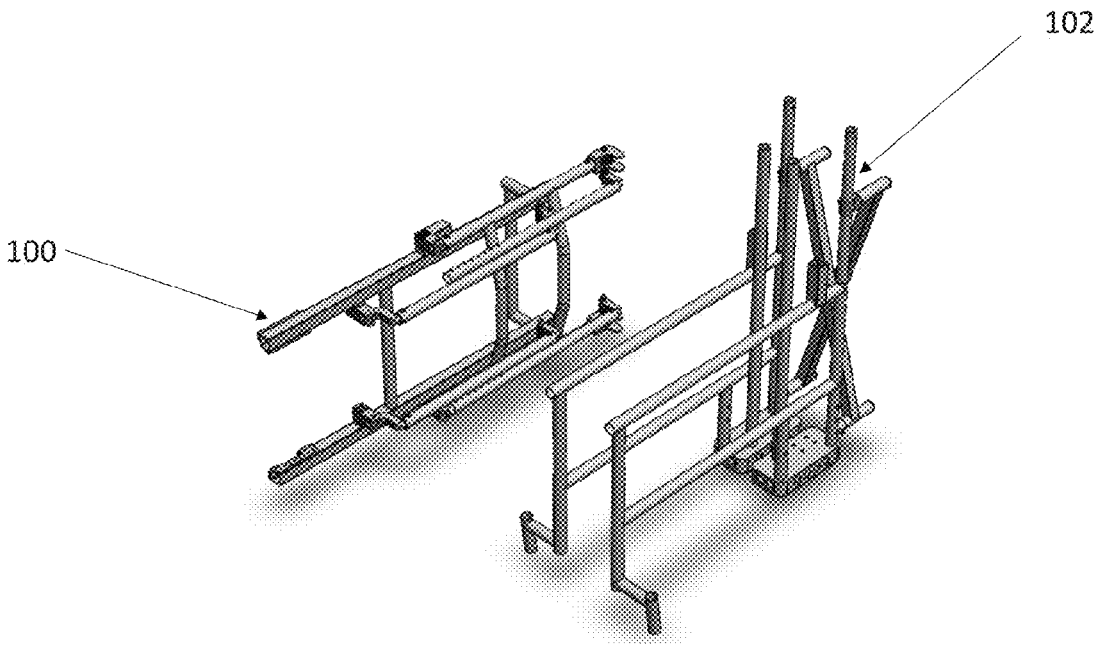
FIG. 20 is an isometric view of detachable sections of the frame of FIG. 18.

In other embodiments, the wheelchair may be motorized or otherwise actuated so that a power source independent of the user is used to raise and lower the wheelchair. In other embodiments as well, the wheelchair may be foldable so that it can be stored and transported more easily. FIG. 18 shows a chair frame 200 that is powered and foldable. A battery 80 provides energy to the motor 82, which extends and retracts an actuator arm 84. Subframe 88, seat members 86, and back subframe 90 provide support to the user when in a sitting position. The rear of the wheelchair frame comprises support brace 92, which is foldable as shown in FIG. 20.

Figure 19A:
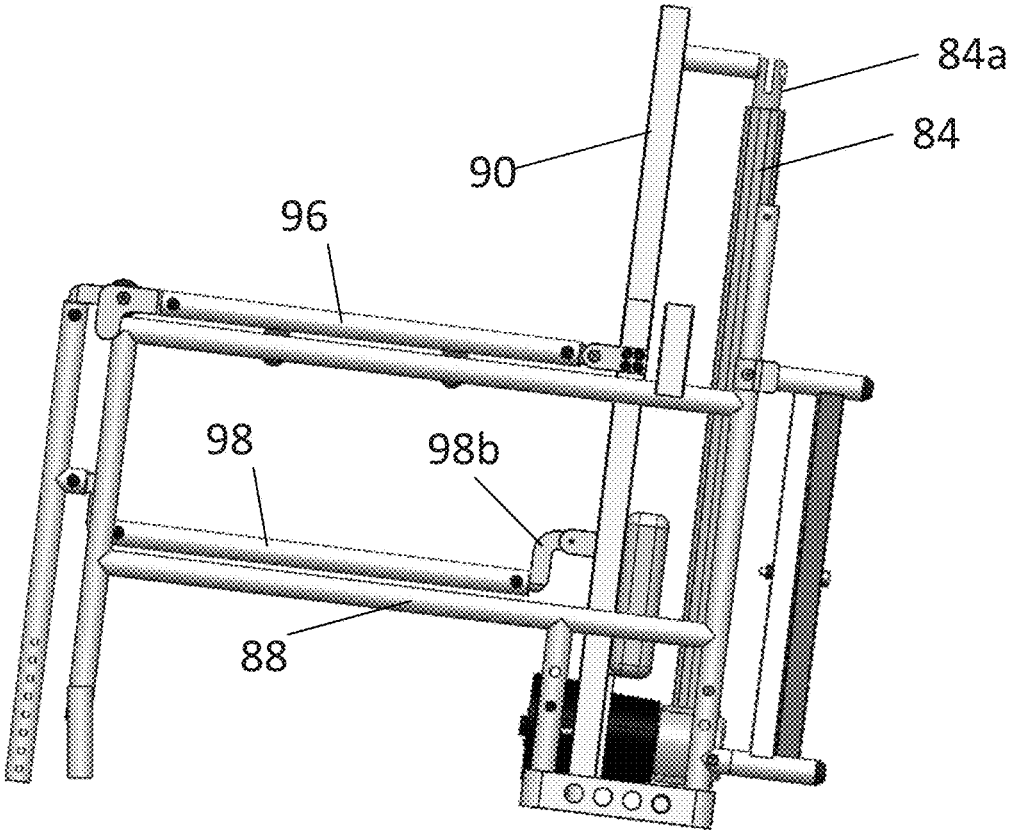
FIG. 19A is a side view of the frame of FIG. 18 in a seated position.
Figure 19B:
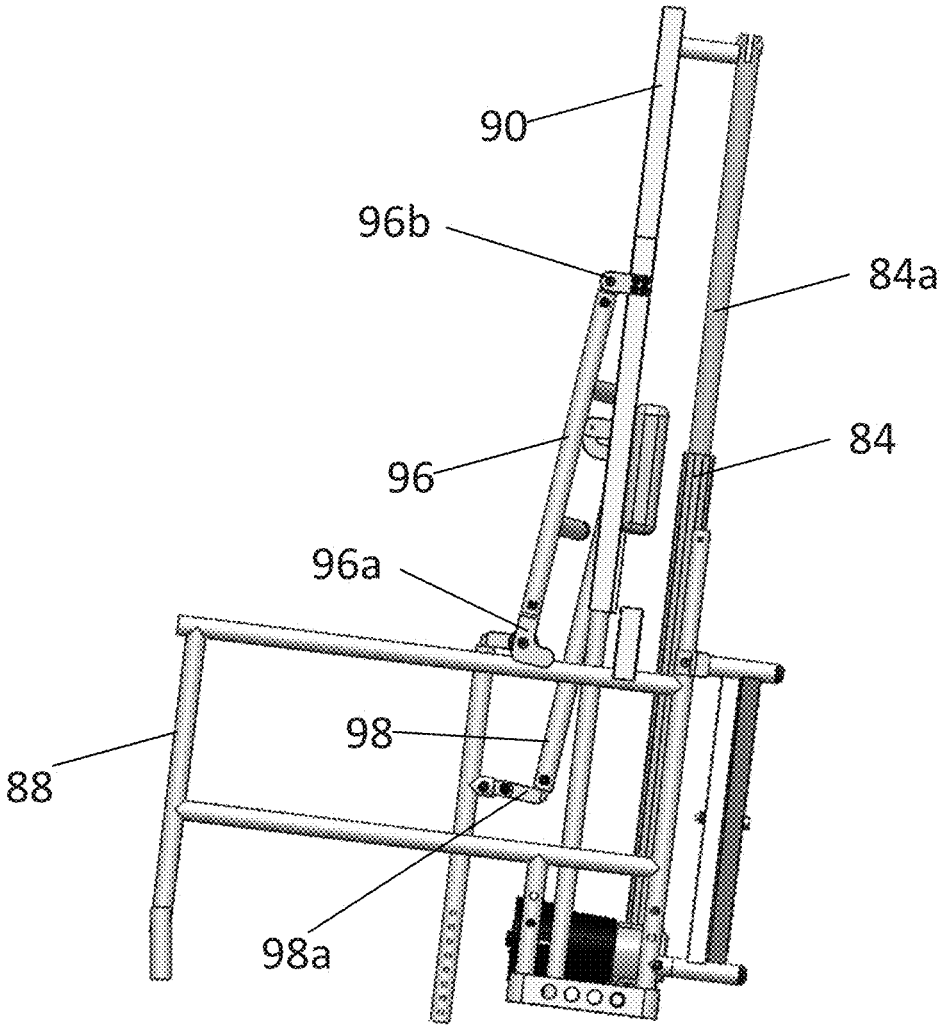
FIG. 19B is a side view of the frame of FIG. 18 in a standing position.

FIG. 19A displays a side view of the chair frame 200 in a seated position, while FIG. 19B displays a side view of the chair frame 200 in a standing position. Ends 96*a* and 96*b* are coupled to the link 96. When the motor 82 is in operation, it can extend the actuator arm 84. End 96*a* is brought along the upper member of subframe 88 and end 96*b* raises along with extendatble back subframe 90, as shown in FIGS. 19A and 19B. Likewise, ends 98*a* and 98*b* pull through member 98 to bring the chair 200 to a standing position.

Chair 200 may be detachable, such that portions of the chair detach for simpler storage. For instance, the chair 200 can be detachable such that sections of the chair can fit in the trunk of a person's car. In one embodiment, shown in FIG. 20, the backrest and seat section 100 of the chair 200 is shown detached from the frame section 102.

The embodiments described herein provide several advantages for individuals who use manual standing wheelchairs. Such advantages, in addition to those already described, include: the ability to drive a manual standing wheelchair in a seated position, standing position or any position in between, and a wider grip surface that provides users with fuller reach and increases their ability to push a wheel rim back and forth in a straight, linear, more natural motion. Another advantage of this wheelchair is that it can be operated by any individual who uses a wheelchair for mobility, including those with a wide range of mobility-limiting disabilities, such as individuals with a spinal cord injury or stroke.

What is claimed is:

1. A drive mechanism for a wheelchair, comprising:

a hand grip in a tread arrangement and providing a surface on which the user can push in order to operate the wheelchair, the hand grip comprising a plurality of hand grip segments, a drive rotator operatively coupled to the hand grip; and a continuous track operatively coupled to the plurality of hand grip segments and to the drive rotator so that rotation of the hand grip about the drive rotator results in corresponding rotation of the continuous track, each hand grip segment moves relative to adjacent hand grip segments as the hand grip segment rotates around the drive rotator, wherein movement of the handgrip in a fore direction or in an aft direction creates a rotational movement of the continuous track and the drive rotator for operation of the wheelchair.

2. The drive mechanism of claim 1, wherein:

a. movement of the hand grip in the fore or the aft direction causes the drive rotator to rotate, and b. rotation of the drive rotator provides the rotational movement for the operation of the wheelchair.

3. The drive mechanism of claim 2, further comprising a shifter, wherein:

a. when the shifter is in a first position, rotation of the drive rotator rotates a wheel of the wheelchair; and b. when the shifter is in a second position, rotation of the drive rotator drives a mechanism that lifts the wheelchair into a standing position.

4. A wheelchair incorporating the drive mechanism of claim 3.

5. The wheelchair of claim 4, wherein a frame of the wheelchair is foldable.

6. The wheelchair of claim 4, wherein the wheelchair is adjustable to a standing position and to a seated position.

7. The wheelchair of claim 6, wherein a frame of the wheelchair is foldable.

8. The wheelchair of claim 4, wherein the wheelchair is powered to adjust the wheelchair to a standing position.

9. The drive mechanism of claim 2, wherein movement of the hand grip in a fore direction causes the drive rotator to rotate in a first direction and movement of the hand grip in an aft direction causes the drive rotator to rotate in a direction opposite to the first direction.

10. A wheelchair incorporating the drive mechanism of claim 2.

11. The wheelchair of claim 10, wherein a frame of the wheelchair is foldable.

12. The wheelchair of claim 10, wherein the wheelchair is adjustable to a standing position and to a seated position.

13. The wheelchair of claim 12, wherein a frame of the wheelchair is foldable.

14. The wheelchair of claim 10, wherein the wheelchair is powered to adjust the wheelchair to a standing position.

15. The drive mechanism of claim 1, wherein the surface of the hand grip is flat.

16. A wheelchair incorporating the drive mechanism of claim 1.

17. The wheelchair of claim 16, wherein a frame of the wheelchair is foldable.

18. The wheelchair of claim 16, wherein the wheelchair is adjustable to a standing position and to a seated position.

19. The wheelchair of claim 18, wherein a frame of the wheelchair is foldable.

20. The wheelchair of claim 16, wherein the wheelchair is powered to adjust the wheelchair to a standing position.

21. The drive mechanism of claim 1 wherein each hand grip segment having a fore end and an aft end, the fore end of a first hand grip segment positioned adjacent to an aft end of a second hand grip segment.

22. The drive mechanism of claim 21 wherein the aft end of the first hand grip segment is positioned adjacent a fore end of a third hand grip segment.

23. The drive mechanism of claim 1 further comprising a drive shaft upon which the drive rotator is rotatably mounted, an idler sprocket for maintaining tension on the continuous track, and an idler shaft upon which the idler sprocket is rotatably mounted.

24. The drive mechanism of claim 23 further comprising a frame extending along the drive mechanism, the drive shaft and the drive rotator positioned at a first end of the frame and the idler shaft and idler sprocket positioned at a second end of the frame, wherein the plurality of hand grip segments and the continuous track rotate about a periphery of the frame.

25. The drive mechanism of claim 23 further comprising an articulating drive mechanism for transferring rotational motion from the drive shaft to a wheel of the wheelchair.

26. A drive mechanism for a wheelchair, comprising:

a hand grip in a tread arrangement, wherein movement of the handgrip in a fore direction or in an aft direction creates a rotational movement for operation of the wheelchair, the hand grip is comprised of a plurality of hand grip segments, and each hand grip segment comprises a slot opening for mechanical connection to a drive mechanism.

27. The drive mechanism of claim 26, wherein the slot opening is positioned at an aft position of the hand grip segment.

* * * * *